US005271108A

United States Patent [19]

Wicke

[11] Patent Number: 5,271,108

[45] Date of Patent: Dec. 21, 1993

[54] SINK DRAIN GUARD

[75] Inventor: Charles A. Wicke, Racine, Wis.

[73] Assignee: Emerson Electric Co., Racine, Wis.

[21] Appl. No.: 954,325

[22] Filed: Sep. 30, 1992

[51] Int. Cl.[5] ..... E03C 1/26

[52] U.S. Cl. ..... 4/629; 4/DIG. 4; 4/292; 210/163; 241/46.013

[58] Field of Search ..... 4/292, 629, 652, DIG. 4; 241/46.013, 46.016; 210/163, 164, 165, 166, 482, 497.01

[56] References Cited

U.S. PATENT DOCUMENTS

| | | | |
|---|---|---|---|
| 2,793,373 | 5/1957 | Ewing | 241/46.016 |
| 3,268,920 | 8/1966 | Beer | 4/292 |
| 3,727,763 | 4/1973 | Arenskov | 210/163 |
| 3,742,524 | 7/1973 | Ballentine | 4/654 |
| 3,982,289 | 9/1976 | Robbins | 4/292 |
| 4,134,162 | 1/1979 | Sharland et al. | 4/292 |
| 4,301,557 | 11/1981 | Walraven | 4/286 |
| 4,519,102 | 5/1985 | Efstratis | 4/292 |
| 4,692,948 | 9/1987 | Martin | 4/534 |
| 4,698,861 | 10/1987 | Bogusz | 4/286 |

FOREIGN PATENT DOCUMENTS

| | | | |
|---|---|---|---|
| 562791 | 12/1957 | Belgium | 210/163 |

*Primary Examiner*—Henry J. Recla
*Assistant Examiner*—Charles R. Eloshway
*Attorney, Agent, or Firm*—Ryan, Kees & Hohenfeldt

[57] ABSTRACT

A sink drain guard is formed of an annular sleeve of flexible, resilient plastic material having a central cylindrical annular wall portion connected at its bottom to an inwardly extending shoulder. The shoulder is provided on its outer perimeter with a peripheral outwardly facing annular groove adapted to receive a flat elastomeric washer encircling its outside. The annular cylindrical central portion is connected at its top to a plurality of outwardly flared segments defined by a plurality of slots extending through a portion of the central cylindrical section and being open at its top. The guard is adapted to be installed in the drain opening of a sink equipped with a garbage disposal unit with the shoulder portion and gasket seated in a shoulder in the drain structure. The slots provide for drainage of liquid from the sink while preventing entry therein of tableware, and the outwardly flared portions provide a gripping surface for removal of the guard from the drain.

5 Claims, 2 Drawing Sheets

SINK DRAIN GUARD

FIELD OF THE INVENTION

The present invention relates to attachments to sink drains More particularly, the invention relates to a removable guard for a sink equipped with a garbage disposal unit for preventing dinnerware from entering the drain and the disposal unit.

BACKGROUND OF THE INVENTION

Various proposals have heretofore been made to provide structures for installation in a sink drain to prevent items such as tableware, cutlery or the like from being washed into a garbage disposal unit during drainage of the sink. Examples of such structures are those shown in U.S. Pat. Nos. 3,742,524; 4,134,162; and 4,301,557. Another device shown in U.S. Pat. No. 4,519,102 provides for a sleeve having a shoulder in which slots are formed in the base of the sleeve and through the shoulder area which is intended to rest on the mouth of the sink drain flange. All of these prior art structures have suffered from problems such as insufficient flow of water into the drain due to clogging or in some cases due to insufficient area of openings in the design.

SUMMARY OF THE INVENTION

It is an object of the present invention to provide an improved guard structure which will prevent tableware and the like from entering a garbage disposal unit but which provides for improved flow of water into the drain. Another aspect of the invention is to provide such a structure in which a gripping surface is provided for easy removal of the structure from the drain. A further aspect of the invention is to provide a guard having an improved structure for fitting into and seating in the drain opening.

A further important aspect of the invention is to provide a drain structure in which water flow slots are provided open at the top. A related aspect involves providing a structure in which the top of the guard is formed of discreet segments which if flexed due to weight of the silverware or the like will tend to reduce the size of the slots thereby further reducing the likelihood that silverware could enter the drain. A further important aspect of the invention is to provide a drain structure in which the openings are so situated as to enable closing of the drain using a conventional sink stopper in order to permit retaining of the water in the sink with the guard in place.

Briefly summarized, the invention provides a sink drain guard formed of an annular sleeve of flexible, resilient plastic material having a central cylindrical annular wall portion connected at its bottom to an inwardly extending shoulder. The shoulder is provided on its outer perimeter with a peripheral outwardly facing annular groove adapted to receive a flat encircling elastomeric washer. The annular cylindrical central portion is connected at its top to a plurality of outwardly flared segments defined by a plurality of slots extending through a portion of the central cylindrical section and is open at its top. The guard is adapted to be installed in the drain opening of a sink equipped with a garbage disposal unit with the shoulder portion and gasket seated in a shoulder in the drain structure The slots provide for drainage of liquid from the sink while preventing entry therein of tableware, and the outwardly flared portions provide a gripping surface for removal of the guard from the drain Preferably, the guard is provided with an internal shoulder situated beneath the lower end of the drainage slots so that the sink drain can be stoppered even with the guard in place.

These and other aspects and advantages of the invention will be further set forth in the following detailed description and accompanying drawings.

DRAWINGS

DETAILED DESCRIPTION

Figure 1:
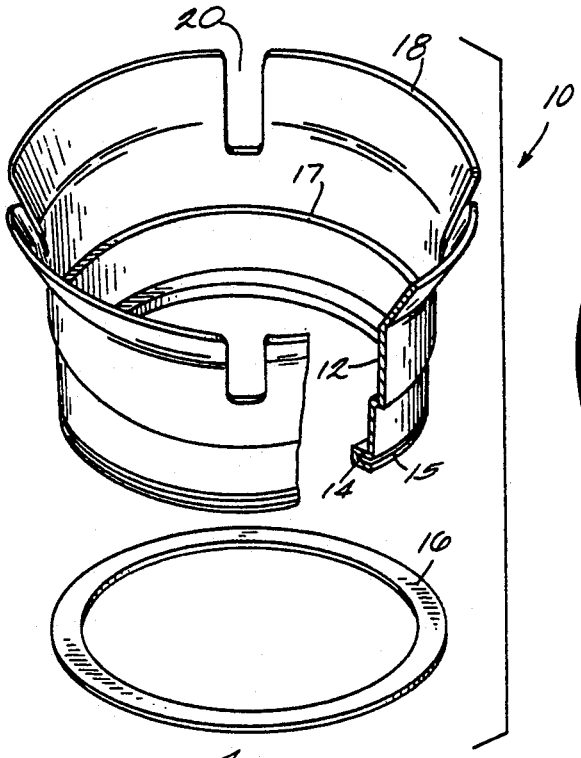
FIG. 1 is a perspective view of a drain guard of the present invention with parts broken away shown in cross-section.
Figure 3:
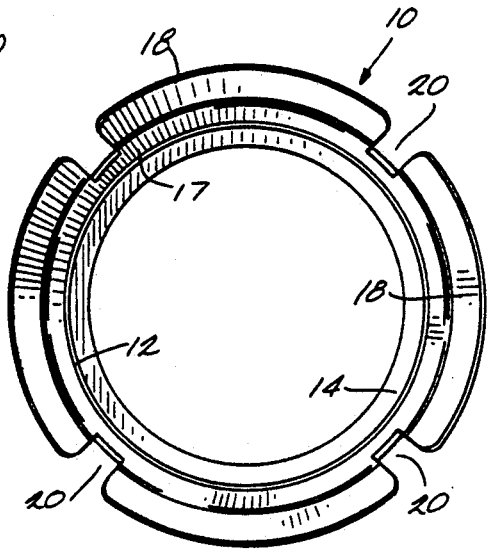
FIG. 3 is a top view of a guard of this invention.

Referring first to FIG. 1, there is seen a sink drain guard in the form of a generally annular sleeve 10. The central portion of sleeve 10 includes a generally cylindrical annular central area 12. A lip 14 at the base of the structure having a peripheral, outwardly facing groove 15 forms a means for seating the guard in a sink drain.

Lip 14 is provided with an outwardly facing circumferential groove 15 for receiving an elastomeric washer 16. As will be further explained, the drain guard structure of this invention can be used with or without ring gasket 16 depending on the type of sink structure in which it is installed.

The upper end of guard structure 10 is formed by a plurality of outwardly flared segments 18 defined by a plurality of slots 20 that are open at the top and that extend the entire height of flared sections 18 and preferably about one-half of the height of central cylindrical section 12 of the guard. An internal shoulder 17 is provided below the lower ends of slots 20.

Figure 2:
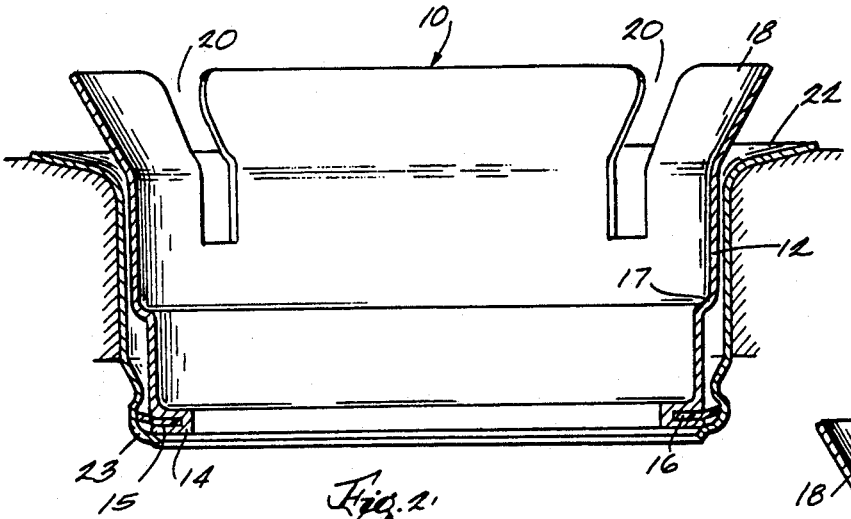
FIG. 2 is a central cross-sectional side view of a guard of the present invention in place in a sink drain.

As seen in FIG. 2, when installed in a normally open drain structure elastomeric gasket 16 is inserted in slot 15 as best seen in FIG. 2. The structure is then installed in opening 22 of a sink drain with lip 14 resting on an interior flange of the drain opening 23. Gasket 16 ensures a close fit of the guard structure in the drain opening while still providing yieldable means that can readily be removed when desired. It will be further noted that because of the outward flare of segments 18 that a surface is provided which allows easy grasping of the structure for removal of the guard when desired. It will further be noted that the sides of slot 20 are parallel to each other as formed. It will further be noted that if any of the segments 18 are deflected inwardly by the weight of tableware or other force that the width of slots 20 will be temporarily reduced in width so as to further reduce the likelihood of entry of tableware into the drain.

Figure 4:
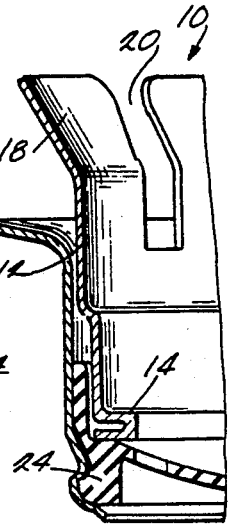
FIG. 4 is a fragmentary side elevational view of the guard shown installed in an alternative type of sink drain; and, FIG. 5 is a central cross-sectional side view of a guard in place in a drain sealed by a stopper.

As seen in FIG. 4, the guard of the present invention can also be installed in a sink drain in conjunction with a further sink strainer structure or removable baffle 24. In this event, lip 14 simply rests on an interior shoulder provided in baffle structure 24. Also note in this event that gasket 16 can simply be omitted.

Figure 5:
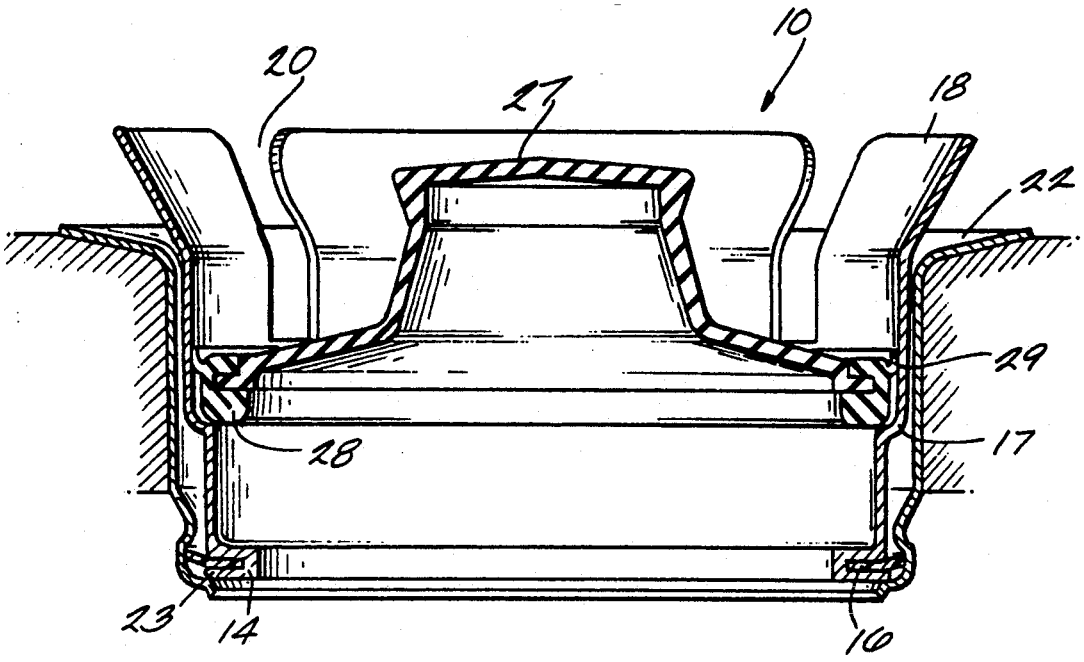

As seen in FIG. 5, a sink drain opening 22 can be tightly closed by a sink stopper 27 even with guard 10 in place. Due to the location of shoulder 17 below the lower ends of slots 20 the inside of guard 10 is tightly closed. Stopper 27 is preferably provided with an elastomeric rim 28. To ensure a watertight seal a lip 29 can also be provided on the perimeter of rim 28. As seen in FIG. 5, washer 16 forms a watertight seal around the exterior of guard 10.

Guard 10 of this invention can be molded from any suitable resilient plastic or elastomeric material such as a stiff synthetic rubber material, a polyolefin, a polyvinylchloride, a polyamine resin or the like. Black polypropylene has been found to be a suitable material.

While preferred embodiments of the invention have been shown for purposes of illustration, it will be apparent to those skilled in the art that various modifications can be made falling within the spirit of the invention and scope of the accompanying claims.

What is claimed is:

1. A sink drain guard adapted to fit in a sink drain opening, said opening defined by a top and a bottom which are separated by a predetermined distance, said guard comprising:

an annular sleeve of flexible, resilient plastic material having a central cylindrical annular wall portion having a height sufficient to extend above said top of sink drain opening and into said sink when the bottom of said sleeve is seated on said bottom of said opening and being connected at its bottom to an inwardly extending shoulder, said shoulder being provided on its outer surface with an annular groove, a flat elastomeric washer encircling the outside of said shoulder and received in said groove, said annular cylindrical central portion being connected at its top to a plurality of outwardly flared segments defined by a plurality of slots extending through a portion of said central cylindrical section and being open at the top end thereof, said guard being adapted to be installed in the drain opening of a sink equipped with a garbage disposal unit with said shoulder portion and gasket seated in a shoulder in said drain structure, said slots providing for drainage of liquid from said sink while preventing entry therein of tableware, and said outwardly flared portions extending above the sink drain opening and providing a gripping surface for removal of said guard from said drain.

2. A guard according to claim 1 wherein said guard is provided with four equally spaced slots around the perimeter of said upper portion of said guard defining four outwardly flared segments.

3. A guard according to claim 1 wherein said slots extend downwardly approximately one-half of the height of said central cylindrical portion.

4. A guard according to claim 1 wherein said central cylindrical portion is provided in two segments of progressively reduced diameter in a downward direction, said segments being joined by an internal shoulder.

5. A guard according to claim 4 wherein said shoulder is located below the lower ends of said slots and is configured to sealingly support a drain plug inserted in said guard.

* * * * *